United States Patent [19]

Clemens

[11] 3,957,217

[45] May 18, 1976

[54] STORAGE DRUM FOR INTERMEDIATE YARN FEEDING DEVICE

[75] Inventor: Robert W. Clemens, Malverne, N.Y.

[73] Assignee: Wesco Industries Corporation, Plainview, N.Y.

[22] Filed: June 25, 1975

[21] Appl. No.: 590,303

[52] U.S. Cl. ..... 242/47.01; 66/132 R; 242/47.12

[51] Int. Cl.[2] ..... B65H 51/20

[58] Field of Search ..... 242/47.01, 47.02, 47.03, 242/47.04, 47.05, 47.06, 47.07, 47.08, 47.09, 47.1, 47.11, 47.12, 47.13; 66/132 R; 139/122 R

[56] References Cited

UNITED STATES PATENTS

| | | | |
|---|---|---|---|
| 3,225,446 | 12/1965 | Sarfati et al. | 242/47.01 X |
| 3,637,149 | 1/1972 | Frei | 242/47.12 X |
| 3,720,384 | 3/1973 | Rosen | 242/47.01 |
| 3,737,112 | 6/1973 | Tellerman et al. | 242/47.01 |
| 3,759,300 | 9/1973 | Pfarrwaller | 242/47.01 X |
| 3,782,661 | 1/1974 | Deniega et al. | 242/47.12 |
| 3,834,635 | 9/1974 | Pfarrwaller | 242/47.01 |

*Primary Examiner*—Stanley N. Gilreath
*Attorney, Agent, or Firm*—Henry R. Lerner

[57] ABSTRACT

A storage drum adapted to have yarn wound thereon tangentially adjacent the rear end thereof for forming thereon a plurality of windings which advance axially toward the forward end thereof. The drum comprises a surface of revolution about the longitudinal axis thereof, which has a yarn loading section and a yarn winding accumulating section joined together at a point of inflection. The yarn loading section extends rearwardly of the point of inflection and the yarn accumulating section extends forwardly of the point of inflection. The loading section is shaped so that a tangent thereto immediately rearwardly of the point of inflection forms an angle with the drum axis whose tangent is greater than the coefficient of static friction between yarn and drum surface and so that tangents to progressively more rearward points along the loading section form progressively larger angles with the drum axis. The accumulating section is shaped so that a tangent thereto immediately forwardly of the point of inflection forms an angle with the drum axis whose tangent is less than the coefficient of dynamic friction between yarn and drum surface and so that tangents to progressively more forward points along the accumulating section form progressively smaller angles with the drum axis.

4 Claims, 5 Drawing Figures

STORAGE DRUM FOR INTERMEDIATE YARN FEEDING DEVICE

BACKGROUND OF THE INVENTION

The present invention relates to intermediate yarn feeding devices of the type wherein yarn from a supply thereof is wound onto a storage member from which it is thereafter unwound and fed to a machine utilizing the yarn such as a textile producing machine or a sewing machine as demanded by said machine for demand feeding or at a predetermined linear rate for positive feeding.

More specifically, the storage member is generally in the shape of a drum with the yarn being wound tangentially about the drum at one end thereof forming a plurality of windings which advance axially toward the opposite end of the drum. Examples of storage drums of the type involved herein are shown in U.S. Pat. Nos. 3,225,446 and 3,737,112. In each case, the storage drum has an accumulating section which is generally cylindrical for the major part thereof and a loading section which may be conical or flared. The yarn is wound onto the drum at said loading section causing the first winding formed thereon to move axially onto the accumulating section which comprises the reduced diameter cylindrical portion of the drum and causing the next succeeding winding formed on the loading section to engage the preceding winding and displace the latter axially. The same process is repeated so that each newly formed winding axially displaces all the preceding windings on the storage drum.

Such prior art storage drum has not been entirely satisfactory for a number of reasons. More specifically, it has been found that in a number of instances, because of the particular profile of the storage drum, the point is reached where additional windings formed on the loading section, rather than axially advancing the precedingly formed windings forwardly toward the other end of the drum, accumulate rearwardly of the last formed winding and thus back-up on the loading section creating a serious problem of entanglement and preventing the formation of the intended single layer of turns of yarn on the drum.

Another problem often arising in conventional storage drums such as those referred to above is that the yarn initially engaging the loading section upon being wound thereon, rather than gradually sliding towards the last previously formed winding, literally jumps to such position.

It must also be recognized that in order for winding to take place upon the loading section of the drum, the yarn must be under some tension causing some elongation thereof. Further, the yarn is loaded onto the loading section, which has a greater diameter than the cylindrical accumulating portion of the storage drum so that as each winding moves from its loading section to the reduced diameter section, the initially elongated winding is partially restored to its unelongated form with resulting reduced tension. Such reduced tension reduces the frictional force opposing axial displacement of the yarn leading in turn to excessive looseness of the yarn windings and thus interferes with the uniform and controlled axial displacement of the windings on the storage drum.

The present invention has as its object the provision of a storage drum which eliminates the above pointed out drawbacks of the prior art storage drums.

SUMMARY OF THE INVENTION

In accordance with the invention, there is provided a storage drum whose profile is defined in a novel manner so as to assure the formation thereon of a uniform layer of windings in side-by-side relation. More specifically, in accordance with the novel profile of the storage drum, the initial yarn windng formed on the loading section gradually moves to a point on the accumulating section immediately past a point of inflection where it stops. Thereafter, the subsequently formed winding, due to the novel profile of the loading section, moves to a position in engagement with the first formed winding and retains sufficient momentum to displace said first formed winding while itself occupying the position formerly occupied by the first formed winding. Similarly, subject to few limited exceptions more fully described hereafter, each subsequently formed winding slides into engagement with the immediately precedingly formed winding, displacing all the precedingly formed windings and occupying the same point immediately past the point of inflection. This is accomplished in accordance with the invention by providing on the drum surface such point of inflection defined by the intersection of two lines one of which forms an angle with the axis of the drum whose tangent is equal to the static coefficient of friction $\mu_s$ between yarn and drum surface and the other one of which forms an angle with such axis whose tangent is equal to the dynamic coefficient of friction $\mu_d$. Immediately rearwardly of the point of inflection the drum surface is shaped so that a line drawn tangently thereat forms an angle with the axis of the drum whose tangent is greater than such static coefficient of friction. Further, the shaping of the loading section as it continues rearwardly of the point of inflection changes in curvature so that tangents at points progressively rearwardly of the point of inflection form gradually increasing angles with the axis of the drum. Conversely, immediately forwardly of the point of inflection the drum is shaped so that a line tangent to the drum surface thereat forms an angle with the axis of the drum whose tangent is less than the dynamic coefficient of friction between yarn and drum surface. As we move progressively forwardly from the inflection point on the drum surface, such surface varies in profile so that tangents drawn to successive points on the drum surface form angles whose tangents are of successively decreasing values.

Under this arrangement of drum profile, the first winding wound onto the loading section will automatically move to a point immediately past the point of inflection since the tangent at any point on the loading section forms an angle with the axis of the drum whose tangent is greater than the static coefficient of friction. As the next turn is wound onto the loading section, it will gradually slide with enough momentum into engagement with the first winding, and thus displacing the first winding and itself occupying the point immediately past the point of inflection.

The momentum of the moving second winding creates a sufficient force to move the first winding forwardly of the point of inflection even though at such point the tangent to the drum surface is less than the dynamic coefficient of friction.

As more turns are wound onto the loading section, the added momentum required to move the previously wound turns is obtained by the previously described varying shape of the loading section rearwardly of the point of inflection.

It is therefore a principal object of the invention to provide a drum profile so that each newly formed winding on the loading section is capable of moving all the previously formed windings on the drum forwardly on the accumulating section, the collective windings on the drum at any point forming a single layer which is axially movable in a controlled manner.

DESCRIPTION OF THE PREFERRED EMBODIMENT

Figure 1A:
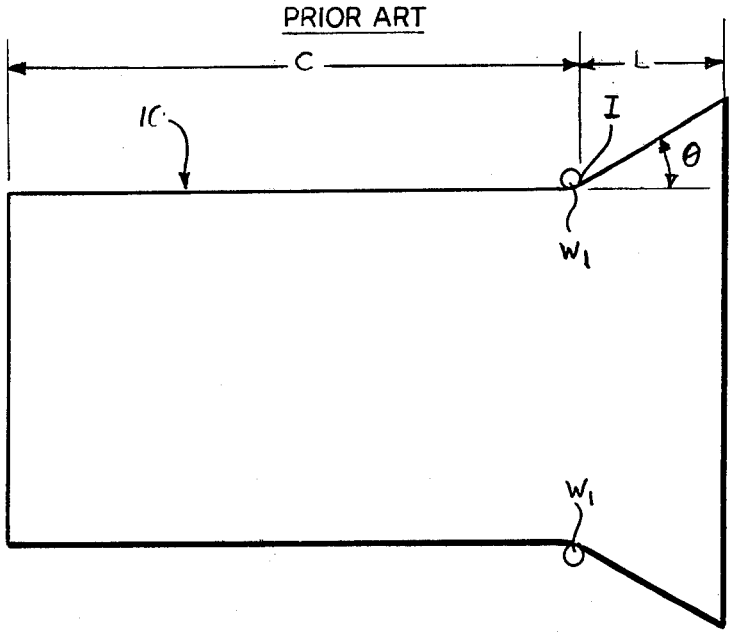
FIG. 1a. PRIOR ART
FIG. 1*a* shows a side view of a storage drum in accordance with the prior art.
Figure 1B:
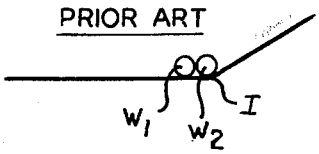
FIG. 1b. PRIOR ART
FIG. 1*b* and FIG. 1*c* are schematic representations illustrating the operation of the storage drum in FIG. 1*a*.
Figure 1C:
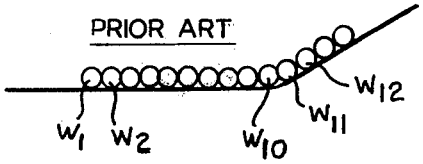
FIG. 1c. PRIOR ART

Referring now to FIG. 1*a*, there is shown a conventional storage drum 10 in accordance with the prior art, such as shown in previously mentioned U.S. Pat. No. 3,225,446. Storage drum 10 comprises a conical loading section L and a cylindrical accumulating section C, which meet at point of inflection I. Upon winding yarn onto loading section L, an initial winding $w_1$ will be formed and, if the tangent of angle $\theta$ (the angle conical section L forms with the drum axis) is equal to or greater than the coefficient of friction between yarn and drum surface, winding $w_1$ will occupy a position immediately past the point of inflection I. The next winding $w_2$ formed on the loading section will move into engagement with $w_1$ and will axially displace $w_1$ forwardly (leftward viewing FIG. 1*a*) and occupy the point of inflection formerly occupied by $w_1$ as shown in FIG. 1*b*. If, however, the tangent of angle $\theta$ is substantially equal to the static coefficient of friction, there will come a time when a newly formed winding will be unable to axially displace all the previously formed windings on the drum causing such newly formed winding to back up on the loading section as shown illustratively in FIG. 1*c* where such condition is shown to occur after the tenth winding. Such condition is obviously unacceptable for the proper functioning of the feeding device of which storage drum 10 is a principal component. Increasing angle $\theta$ so that its tangent is substantially greater than the coefficient of static friction would not be a satisfactory solution as it would provide excessive momentum to the first formed windings on the loading section resulting in the absence of a uniform advancing single layer of windings on the accumulating portion of the storage drum, causing undesirable looseness.

Figure 2A:
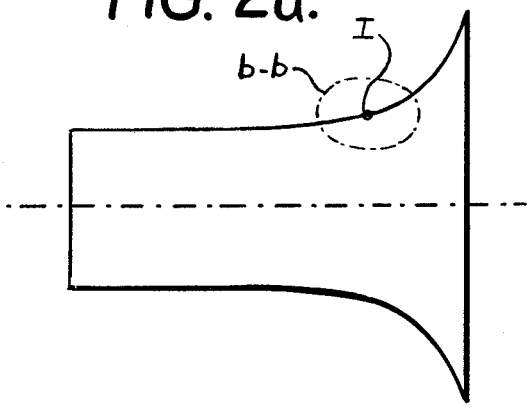
FIG. 2*a* shows a side view of the storage drum in accordance with the invention.

FIG. 2*a* represents a side view of the storage drum in accordance with the invention, such figure showing an area delineated by lines *b*—*b*, the profile of which constitutes the main aspect of the invention.

Figure 2B:
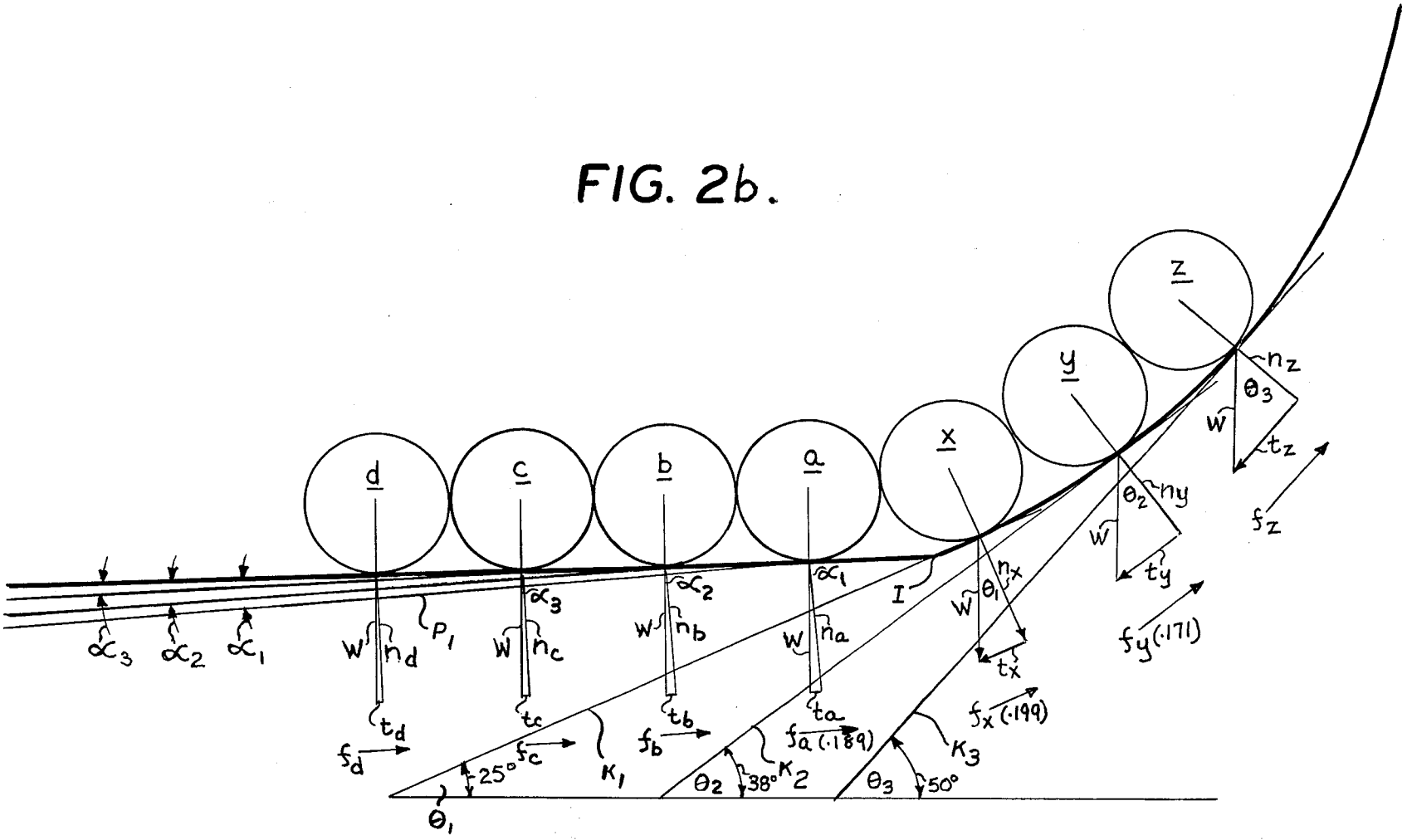
FIG. 2*b* shows the area denoted by lines *b*—*b* of FIG. 2*a*, in an enlarged scale, schematically illustrating the construction and manner of operation of the storage drum in accordance with the invention.

Referring now to FIG. 2*b*, there is shown an enlarged schematic representation of the portion *b*—*b* in FIG. 2*a* showing the manner of functioning of a drum profile in accordance with the invention. The profile of FIG. 2*b* is one which is based on a drum surface made of aluminum and intended to utilize yarn which has the following coefficients of friction with respect to the drum:

$\mu_s$(coefficient of static friction) = 0.22

$\mu_d$(coefficient of dynamic friction) = 0.19

In accordance with the preferred embodiment of the invention, point of inflection I, previously described, is defined by the intersection of a line $K_1$ forming an angle $\theta_1$ of 25° with the drum axis and a line $P_1$ forming an angle $\alpha_1$ of 5° with such axis. Accordingly, it will be noted that the tangent of $\theta_1$ (25°) is greater than $\mu_s$ while the tangent of $\alpha_1$ (5°) is less than $\mu_d$.

As further noted in FIG. 2, as we move rearwardly (rightward) of the point of inflection, the drum profile is such so as to form successive tangents with the axis of the drum at increasing values such as $\theta_2$ of 38° and $\theta_3$ of 50° corresponding to yarn turn positions *y* and *z*, respectively. Similarly, as we move forwardly (leftward) along the profile of the drum, tangents formed at successively spaced points corresponding to yarn winding positions *b*, *c*, and *d*, form angles $\alpha$ of decreasing values, namely $\alpha_2$ of 4°, $\alpha_3$ of 3° and $\alpha_4$ of 2°.

With the above profile structure of the drum, an analysis of the formation of turns on the drum is now in order.

a. Formation of First Turn $T_1$

With the above definition of drum profile and assuming the tension of a turn of yarn being wound to be the equivalent of a weight W of unity, the first turn $T_1$ formed on the drum at position *x* just rearwardly of point I and will apply force W to the drum in a direcion perpendicular to the axis of the drum. Force W is resolvable into its normal component $n_x$ (perpendicular to line $K_1$) and tangential component $t_x$ parallel to line $K_1$, it being understood that $t_x$ is the component of W tending to oppose the opposite frictional force $f_x$. On the basis of W being unity, the following can be established:

$$t_x = \sin\theta_1 = 0.422$$

$$f_x = \mu_s n_x = \mu_s \cos\theta_1 = 0.22\ (0.906) = 0.199$$

Since $t_x$ (the force tending to cause the winding to slide down) is greater than $f_x$ (the opposing frictional force), the first formed turn will slide to inflection point I where it will encounter line $P_1$ having the $\alpha_1$ (5°) slope and occupy position *a* on the accumulating section.

b. Formation of Second Turn $T_2$

The next turn $T_2$ will be formed on the drum at position *x*, in engagement with turn $T_1$ which occupies position *a*. At such moment, the relevant forces as shown in FIG. 2 are as follows:

Total tangential components of $T_1$ and $T_2 = t_x + t_a$ $$\begin{aligned} t_x + t_a &= \sin\theta_1 + \sin\alpha_1 \\ &= .422 + .087 \\ &= .509 \end{aligned}$$

Total frictional force opposing $T_1$ and $T_2 = f_x + f_a$ $$\begin{aligned} f_x + f_a &= \mu_d n_x + \mu_d n_a = \mu_d \cos\theta_1 + \mu_d \cos\alpha_1 \\ &= .19\ (.906) + .19\ (.996) \\ &= .172 + .189 \\ &= .361 \end{aligned}$$

The total tangential forces (0.509) are thus seen to exceed the total opposing frictional forces (0.361)

whereby turn $T_2$ will cause $T_1$ to occupy position $b$ with $T_2$ itself moving to position $a$.

c. Formation of Third Turn $T_3$

Turn $T_3$ will be formed on the drum and occupy position $x$, in engagement with turn $T_2$ which occupies position $a$. At such moment, the relevant forces as shown in FIG. 2 are as follows:

Total tangential components of $T_1$, $T_2$ and $T_3 = t_x + t_a + t_b$ $$\begin{aligned} t_x + t_a + t_b &= \sin\theta_1 + \sin\alpha_1 + \sin\alpha_2 \\ &= .422 + .087 + .070 \\ &= .579 \end{aligned}$$

Total frictional force opposing $T_1$, $T_2$ and $T_3 = f_x + f_a + f_b$ $$\begin{aligned} f_x + f_a + f_b &= \mu_d\cos\theta_1 + \mu_d\cos\alpha_1 + \mu_d\cos\alpha_2 \\ &= .19\ (.906) + .19\ (.996) + .19\ (.997) \\ &= .172 + .1892 + .1894 \\ &= .5506 \end{aligned}$$

The total tangential forces (0.579) are thus seen to exceed the total opposing frictional forces (0.5506) whereby turn $T_3$ will cause turns $T_2$ and $T_1$ to occupy positions $b$ and $c$, respectively, with $T_3$ itself moving to position $a$.

d. Formation of Fourth Turn $T_4$

Turn $T_4$ will be formed on the drum and occupy position $x$, in engagement with turn $T_3$ which occupies position $a$. At such moment the relevant forces as shown in FIG. 2 are as follows:

Total tangential components of $T_1$, $T_2$, $T_3$ and $T_4 = t_x + t_a + t_b + t_c$ $$\begin{aligned} t_x + t_a + t_b + t_c &= \sin\theta_1 + \sin\alpha_1 + \sin\alpha_2 + \sin\alpha_3 \\ &= .422 + .087 + .070 + .052 \\ &= .631 \end{aligned}$$

Total frictional force opposing $T_1$, $T_2$, $T_3$ and $T_4$ 32 $f_x + f_a + f = + f_c$ $$\begin{aligned} f_x + f_a + f_b + f_c &= \mu_d\cos\Theta_1 + \mu_d\cos\alpha_1 + \mu_d\cos\alpha_2 + \mu_d\cos\alpha_3 \\ &= .19\ (.906) + .19\ (.996) + .19\ (.997) + .19\ (.998) \\ &= .177 + .1892 + .1894 + .1896 \\ &= .7402 \end{aligned}$$

Since the total opposing frictional force (0.7402) exceeds the total tangential components (0.631), turn $T_4$ will remain at position $x$.

e. Formation of Fifth Turn $T_5$

Turn $T_5$ will be formed on the drum and, since $T_4$ is at position $x$, $T_5$ will occupy position $y$ in engagement with $T_4$. At position $y$, it will be noted, tangent line $K_2$ forms $\theta_2$ of 38° with the drum axis so that the relevant forces as turn $T_5$ is formed are as follows:

Total tangential components of $T_1$, $T_2$, $T_3$, $T_4$ and $T_5 = t_y + t_x + t_a + t_b + t_c$ $$\begin{aligned} t_y + t_x + t_a + t_b + t_c &= \sin\theta_2 + \sin\theta_1 + \sin\alpha_1 + \sin\alpha_2 + \sin\alpha_3 \\ &= .615 + .422 + .087 + .070 + .052 \\ &= 1.246 \end{aligned}$$

Total frictional force opposing $T_1$ through $T_5 = f_y + f_x + f_a + f_b + f_c$ $$\begin{aligned} f_y + f_x + f_a + f_b + f_c &= \mu_s\cos\theta_2 + \mu_s\cos\theta_1 + \mu_s\cos\alpha_1 \\ &\quad + \mu_s\cos\alpha_2 + \mu_s\cos\alpha_3 \\ &= .22\ (.778) + .22\ (.906) + .22\ (.996) \\ &\quad + .22\ (.997) + .22\ (.998) \\ &= .171 + .199 + .2191 + .2193 + .2195 \\ &= 1.028 \end{aligned}$$

Thus it is seen that due to the fact that the tangent $K_2$ to the drum profile at position $y$ forms a greater angle with the drum axis, turn $T_5$ has sufficiently added tangential force to cause movement of all preceding turns with $T_5$ moving to position $x$ and causing turns $T_4$, $T_3$, $T_2$ and $T_1$ to occupy positions $a$, $b$, $c$ and $d$, respectively.

In connection with the description of turn $T_5$, it will be noted that the relevant calculations utilized the static instead of the dynamic coefficient of friction because at the time $T_5$ was wound the preceding turns were at a momentary standstill. Once $T_5$ is wound however, all turns are displaced and moving, and further calculations are based on the lower dynamic coefficient of friction. Accordingly, a great many additional turns can be wound onto the drum before the next standstill occurs, requiring the added momentum provided by a next turn at point $z$, whose tangent line $K_3$ forms a yet greater angle (50°) with the drum axis.

Thus it is seen that by forming the profile of the drum so that tangent lines thereto at points successively rearwardly of the point of inflection form progressively increasing angles $\theta$ with the drum axis, each newly formed winding will advance all previously formed windings axially forwardly of the drum except only those few and far between windings each of which merely engages the preceding winding so that the next formed winding will be formed on the loading section at a point whose tangent forms a greater angle with the drum axis so as to provide sufficient momentum to displace all preceding windings.

Referring now to the portion of the drum forwardly of the point of inflection, it must be noted that, at such portion, the drum diameter is of decreasing value whereby as a winding moves forwardly, the yarn tension thereof decreases, whereby its equivalent weight (W) is correspondingly decreased. Such decrease in W decreases the frictional force opposing axial forward movement of the winding tending to cause looseness thereof and uncontrolled forward movement thereof. It is in order to avoid such undesirable condition that the profile of the drum is formed so that tangent lines thereto at points successively forwardly of the point of inflection from progressively decreasing angles $\alpha$ with the drum axis. Such decrease in angle $\alpha$: (1) increases the normal component of W, thereby increasing the frictional force $\mu_d w_n$ and (2) decreases the tangential component of W, thereby decreasing the force tending to move the winding in uncontrolled manner.

It will be understood that variations of drum profile from the specific example above described may be made to accommodate different yarns or ranges thereof, as well as to take into account different coefficients of friction due to varying drum surface characteristics.

Having thus described my invention, what I claim and desire to secure by letters patent is:

1. A storage drum adapted to have yarn wound thereon tangentially adjacent the rear end thereof for forming thereon a plurality of windings which advance axially toward the forward end thereof comprising, a surface of revolution about the longitudinal axis of the drum, said surface having a yarn loading section and a yarn winding accumulating section joined together at a point of inflection, said yarn loading section extending rearwardly of said point of inflection and said yarn accumulating section extending forwardly of said point of inflection, said loading section being shaped so that a tangent thereto immediately rearwardly of the point of inflection forms an angle with the drum axis whose tangent is greater than the coefficient of static friction between yarn and drum surface and so that tangents to progressively more rearward points along said loading section form progressively larger angles with the drum axis, said accumulating section being shaped so that a tangent thereto immediately forwardly of the point of inflection forms an angle with the drum axis whose tangent is less than the coefficient of dynamic friction between yarn and drum surface and so that tangents to progressively more forward points along the accumulating section form progressively smaller angles with the drum axis.

2. A storage drum in accordance with claim 1 whose surface is made of aluminum.

3. A storage drum in accordance with claim 1, wherein said tangent to the loading section immediately rearwardly of said point of inflection forms an angle with the drum axis which is greater than 13° and said tangent to the accumulating section immediately forwardly of said point of inflection forms an angle with the drum axis which is less than 11°.

4. A storage drum in accordance with claim 2, wherein said tangent to the loading section immediately rearwardly of said point of inflection forms an angle with the drum axis which is greater than 13° and said tangent to the accumulating section immediately forwardly of said point of inflection forms an angle with the drum axis which is less than 11°.

* * * * *